US007938164B2

(12) United States Patent
Blejde et al.

(10) Patent No.: US 7,938,164 B2
(45) Date of Patent: May 10, 2011

(54) PRODUCTION OF THIN STEEL STRIP

(75) Inventors: Walter N. Blejde, Brownsburg, IN (US); Rama Ballav Mahapatra, Brighton-le-Sands (AU); Harold Bradley Rees, Ladoga, IN (US)

(73) Assignee: Nucor Corporation, Charlotte, NC (US)

( * ) Notice: Subject to any disclaimer, the term of this patent is extended or adjusted under 35 U.S.C. 154(b) by 353 days.

(21) Appl. No.: 12/126,471

(22) Filed: May 23, 2008

(65) Prior Publication Data

US 2008/0257523 A1 Oct. 23, 2008

Related U.S. Application Data

(63) Continuation-in-part of application No. 10/417,694, filed on Apr. 17, 2003, now Pat. No. 7,404,431.

(60) Provisional application No. 60/385,783, filed on Jun. 4, 2002.

(51) Int. Cl.
*B22D 11/06* (2006.01)
*B22D 11/18* (2006.01)

(52) U.S. Cl. ..... 164/453; 164/480

(58) Field of Classification Search ..... 164/480, 164/428, 452, 453, 151.3, 449.1, 450.4, 155.4, 164/155.7, 154.5
See application file for complete search history.

(56) References Cited

U.S. PATENT DOCUMENTS 5,031,688 A 7/1991 Burgo et al.
5,052,467 A 10/1991 Tanaka et al.
5,205,982 A 4/1993 Fukase et al.
5,462,109 A 10/1995 Vincze et al.
5,488,988 A 2/1996 Fukase et al.
5,520,243 A 5/1996 Freeman et al.
5,988,258 A * 11/1999 Blejde et al. ..... 164/453
6,092,586 A 7/2000 Schonbeck (Continued)

FOREIGN PATENT DOCUMENTS

EP 0 684 098 A2 11/1995

(Continued)

OTHER PUBLICATIONS

AU2008904325 International-Type Search Report.

(Continued)

*Primary Examiner* — Kevin P Kerns
(74) *Attorney, Agent, or Firm* — Hahn Loeser & Parks LLP

(57) ABSTRACT

A method of continuously casting metal strip for a twin roll caster may include steps of sensing images of a casting pool in the casting area indicative of the casting pool depth, displaying the sensed images to an operator, and controlling a flow of molten metal from a metal supply system into the casting pool responsive to the sensed images indicative of the casting pool depth. The method may include producing separate electrical signals corresponding to the sensed images and controlling the flow of molten metal from the metal supply system into the casting pool responsive to one or more of the electrical signals. The electrical signals may be processed to determine the casting pool depth in each of the plurality of locations and the casting pool depth displayed to the operator. One or a combination of the electrical signals may be selected for providing a determined casting pool depth, and the flow of molten metal may be controlled responsive to the determined casting pool depth. The determined casting pool depth may be an average of casting pool depths from the selected electrical signals.

36 Claims, 9 Drawing Sheets

U.S. PATENT DOCUMENTS

| | | | | |
|---|---|---|---|---|
| 6,408,222 | B1 | 6/2002 | Kim et al. | |
| 6,474,403 | B1 | 11/2002 | Nikolovski et al. | |
| 6,524,408 | B1 | 2/2003 | Schmitz et al. | |
| 6,575,225 | B1 | 6/2003 | Hohenbichler et al. | |
| 6,581,672 | B2 | 6/2003 | Strezov et al. | |
| 6,896,034 | B2 | 5/2005 | Strezov et al. | |
| 7,404,431 | B2 * | 7/2008 | Blejde et al. | 164/452 |
| 2002/0029865 | A1 * | 3/2002 | Kneppe et al. | 164/453 |
| 2007/0295473 | A1 | 12/2007 | Lee et al. | |

FOREIGN PATENT DOCUMENTS

| | | | |
|---|---|---|---|
| EP | 0 867 244 | A1 | 9/1998 |
| JP | 60049836 | A | 3/1985 |
| JP | 63224846 | A | 9/1988 |
| JP | 1154850 | A | 6/1989 |
| JP | 02-052149 | A | 2/1990 |
| JP | 05-277658 | | 10/1993 |
| JP | 07-132349 | A | 5/1995 |
| JP | 10-005959 | | 1/1998 |
| JP | 2002-143988 | A | 5/2002 |
| JP | 2002-263810 | | 9/2002 |
| WO | 02/26423 | A1 | 4/2002 |
| WO | 02/28569 | A1 | 4/2002 |

OTHER PUBLICATIONS

ISR_AU2008904325.

* cited by examiner

PRODUCTION OF THIN STEEL STRIP

This application is a continuation-in-part of application Ser. No. 10/417,694, now U.S. Pat. No. 7,404,431, filed Apr. 17, 2003, which claims priority to, and the benefit of U.S. provisional patent application 60/385,783, filed Jun. 4, 2002. U.S. Pat. No. 7,404,431 and Application Ser. No. 60/385,783 are incorporated herein by reference.

BACKGROUND AND SUMMARY

This disclosure relates to the casting of thin steel strip by continuous casting in a twin roll caster.

In a twin roll caster, molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the casting rolls to dam the two ends of the casting pool against outflow. The casting of steel strip in twin roll casters of this kind is for example described in U.S. Pat. Nos. 5,184,668; 5,277,243; and 5,934,359.

Further, the twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the casting of thin steel strip.

When casting steel strip in a twin roll caster, the strip leaves the nip at temperatures of the order of 1400° C., and if exposed to air, the strip suffers very rapid scaling due to oxidation of the strip at such temperatures.

It has therefore been proposed to shroud the newly cast strip within an enclosure containing a non-oxidizing atmosphere until its temperature has been reduced, typically to a temperature of the order of 1200° C. or less to reduce scale formation. One such proposal is described in U.S. Pat. No. 5,762,126 according to which the cast strip is passed through a sealed enclosure in which oxygen levels are reduced by initial oxidizing of the strip passing through the enclosure. Thereafter the oxygen content in the sealed enclosure is maintained at less than the surrounding atmosphere by continuing oxidizing of the strip passing through the enclosure and controlling the thickness of the scale on the strip emerging from the enclosure. The emerging strip may be reduced in thickness in an in-line rolling mill and then generally subjected to forced cooling, for example by water sprays, and the cooled strip is then coiled in a conventional coiler.

As more fully described in U.S. Pat. No. 6,585,030 and International Application PCT/AU01/01215, steel strip can be produced from molten steel of a given composition with any of a wide range of microstructures, and in turn a wide range of yield strengths, by continuously casting the strip and thereafter selectively cooling the strip to transform the strip from austenite to ferrite in a temperature range between 850° C. and 400° C. It is understood that the transformation range is within the range between 850° C. and 400° C. and not that entire temperature range. The precise austenite to ferrite transformation temperature range will vary with the chemistry of the steel composition and processing characteristics.

Specifically, from work carried out on plain carbon steel, including low carbon steel that has been silicon/manganese killed or aluminum killed, it has been determined that selecting cooling rates in the range of 0.010° C./sec to greater than 100° C./sec, to transform the strip from austenite to ferrite in a temperature range between 850° C. and 400° C., can produce steel strip that has yield strengths that range from 200 MPa to 700 MPa or greater. By selection of an appropriate cooling rate, it is possible to produce a microstructure which governs the yield strength selected from a group that includes microstructures that are (1) predominantly polygonal ferrite; (2) a mixture of polygonal ferrite and low temperature transformation products and (3) predominantly low temperature transformation products. The term "low temperature transformation products" includes Widmanstatten ferrite, acicular ferrite, bainite and martensite.

This development enables production of thin steel strip from molten steel of a given chemistry to meet differing customer-specified yield strength properties by varying the conditions under which the as-cast strip is cooled through the austenite to ferrite transformation range.

As described in U.S. Pat. No. 6,581,672, it is also possible to change other process parameters in the strip casting process to produce strip meeting varying customer-specified properties from a given strip casting line.

By the present disclosure, the thickness of the as-cast strip is controlled by changing the depth of the casting pool. This enables the casting rolls to be operated at a generally constant heat flux, which permits increased throughput without generating excessive wear temperatures at the casting surfaces, while varying the strip thickness. Accordingly, a single-roll profile may be used for casting rolls with a substantially constant throughput to produce a broad range of different cast strip thicknesses. Also, a constant as-cast microstructure can be maintained in the cast strip, which can consistently and predictably be modified and controlled by the subsequent cooling regime to produce strip having customer-specified properties. Further, increased flexibility in varying the thickness of the as-cast strip is provided that enables the subsequent reduction in the in-line rolling mill to be selected for desired strip thickness.

Specifically, described is a method of casting cast steel strip from a casting pool of molten steel using the casting surfaces of a twin roll caster to produce strip of differing thicknesses in the as-cast condition, comprising:

(a) determining for each desired thicknesses of the as-cast strip, a target casting speed which will avoid over-heating of the casting roll surfaces;

(b) determining from each target casting speed a target casting pool depth to produce a cast strip of the desired thickness when the twin roll caster is operated at the target casting speed; and (c) operating the caster to cast strip based on the determined target casting speed and the determined target depth to produce cast strip generally of the desired thickness.

The method may be performed with a single or twin-roll caster. The as-cast strip may have differing thicknesses, which may be customer-specified, or may be reduced, as by for example in-line rolling, to a desired customer-specified thickness.

In determining the target casting speed and the target casting pool depth, predetermined characteristics of the casting rolls of the roll casters such as the diameter of the casting rolls and heat flux rate through the casting surfaces may be factors to be considered. The casting rolls may include copper or copper alloy sleeves defining the casting surfaces of the rolls. In this case, the casting roll characteristics may include the diameter of the rolls and the thickness of the sleeves, which affect the relation between the casting speed and the casting surface temperature for a particular heat flux.

If these physical characteristics of the casting rolls remain essentially the same, then the caster can be operated at substantially the same production throughput rate, hence it is possible to calculate the target casting speed (u) for a given cast thickness, and then the target casting pool depth is varied to control the as-cast thickness of the strip, i.e., the target casting pool depth is decreased to decrease the as-cast thickness of the strip.

The casting pool depth is measured from the nip of the casting roll, where the strip departs from the casting surfaces of the casting rolls, vertically to the level of the casting pool. The target pool depth may be determined from the target casting speed in accordance with the following equation:

$$R\sin^{-1}\left(\frac{h}{R}\right) = u * \frac{d^2}{k^2}$$

where, h=pool depth (mm),
R=casting roll radius (mm),
d=half strip thickness (mm),
k=roll k-factor ($mm/min^{0.5}$),
u=casting speed (mm/min).

The roll k-factor is determined empirically by determining solidification rates in accordance with the formula:

$$d=k\sqrt{t}$$

where d is the half strip thickness, and t is solidification time.

We have found that the selected depth of the casting pool may be monitored and controlled using image sensors such as cameras. Further, the flow of molten metal in the metal delivery system may be monitored and used to control the selected casting pool depth.

Also disclosed is a method of continuously casting metal strip comprising:

assembling a pair of counter-rotatable casting rolls having casting surfaces laterally positioned to form a nip therebetween through which thin cast strip can be cast, and a metal supply system capable of delivering molten metal above the nip;

forming a casting pool of molten metal supported on the casting surfaces above the nip to form a casting area;

sensing images of the casting pool in a plurality of locations in the casting area indicative of the casting pool depth in the plurality of locations;

displaying the sensed images to an operator; and controlling a flow of molten metal from the metal supply system into the casting pool responsive to the sensed images indicative of the casting pool depth.

The method of continuously casting metal strip may further include producing separate electrical signals corresponding to the sensed images indicative of the casting pool depth in each of the plurality of locations, receiving the separate electrical signals indicative of the casting pool depth in the plurality of locations, and controlling a flow of molten metal from the metal supply system into the casting pool responsive to one or more of the electrical signals. The electrical signals may be processed to determine the casting pool depth in each of the plurality of locations and the casting pool depth displayed to the operator.

One or a combination of separate electrical signals indicative of desired sensed images of the casting pool depth in the desired locations may be selected for providing a determined casting pool depth, and the flow of molten metal from the metal supply system into the casting pool controlled responsive to the determined casting pool depth. The method may include averaging the casting pool depths from the selected electrical signals for providing the determined casting pool depth.

The method of continuously casting metal strip may comprise in addition the steps of:

determining a target casting speed and a target casting pool depth to produce a cast strip of desired thickness when casting at the target casting speed;

determining the difference between the determined casting pool depth and the target casting pool depth; and controlling a flow of molten metal from the metal supply system into the casting pool responsive to the difference between the determined casting pool depth and the target casting pool depth.

The target pool depth may be determined in accordance with the following equation:

$$h = R\sin\left[\frac{u}{R} * \frac{d^2}{k^2}\right]$$

where h=pool depth (mm), R=casting roll radius (mm), d=half strip thickness (mm), k=roll k-factor ($mm/min^{0.5}$), u=casting speed (mm/min), and $k=d/\sqrt{t}$ where d is the half strip thickness and t is solidification time.

The metal supply system may include a tundish capable of delivering molten metal through a distributor to a delivery nozzle, so that the step of controlling the flow of molten metal from the metal supply system into the casting pool is performed by controlling the flow of molten metal from the tundish to the distributor. The weight of the molten metal in the distributor may be sensed, producing electrical signals indicative of the weight of the molten metal in the distributor, and the flow of molten metal from the tundish to the distributor controlled responsive to the electrical signals indicative of the weight of molten metal in the distributor.

A method is also disclosed of continuously casting metal strip may include:

sensing an image of the flow of molten metal from the metal supply system into the delivery nozzle in a plurality of locations in the casting area;

displaying the sensed images to the operator; and controlling the flow of molten metal from the metal supply system into the delivery nozzle responsive to the sensed images of the flow of molten metal into the delivery nozzle.

The method of continuously casting metal strip may further include producing electrical signals corresponding to the sensed images of the flow of molten metal into the delivery nozzle in each of the plurality of locations, receiving the electrical signals indicative of the flow of molten metal into the delivery nozzle in the plurality of locations, and controlling the flow of molten metal from the metal supply system into the delivery nozzle responsive to the electrical signals indicative of the flow of molten metal into the delivery nozzle. At least a portion of the metal supply system may be maintained responsive to the sensed images of the flow of molten metal into the delivery nozzle.

Sensing images may be performed by a plurality of digital or analog cameras operatively positioned in the casting area, and in one configuration may include sensing images of the casting pool in at least four locations in the casting area. In addition, at least one camera may be operatively positioned to sense images adjacent a side dam retaining the casting pool at an end of the casting rolls (in the area known as the triple point region). This sensing of images in the triple point region may be done by such cameras directly, or remotely by positioning fiber optic sensors in the triple point region. The triple point region is the interface between the side dam, the casting rolls, and the casting pool. Also, the sensing of images in the casting area may include providing a plurality of fiber optic sensors operatively positioned in the casting area.

In an alternate method of continuously casting metal strip, the steps include:

assembling a pair of counter-rotatable casting rolls having casting surfaces laterally positioned to form a nip therebetween through which thin cast strip can be cast, a tundish capable of delivering molten metal through a distributor to a delivery nozzle capable of delivering molten metal above the nip and forming a casting pool of molten metal supported on the casting surfaces above the nip in a casting area with side dams adjacent the ends of the nip to confine the casting pool;

sensing the weight of the molten metal in the distributor and producing electrical signals indicative of the weight of the molten metal in the distributor; and controlling flow of molten metal from the tundish to the casting pool responsive to the electrical signals indicative of the weight of molten metal in the distributor.

BRIEF DESCRIPTION OF THE DRAWINGS

In order that the invention may be more fully explained exemplary embodiments are described below with reference to the accompanying drawings, in which.

DETAILED DESCRIPTION OF THE DRAWINGS

Figure 1:
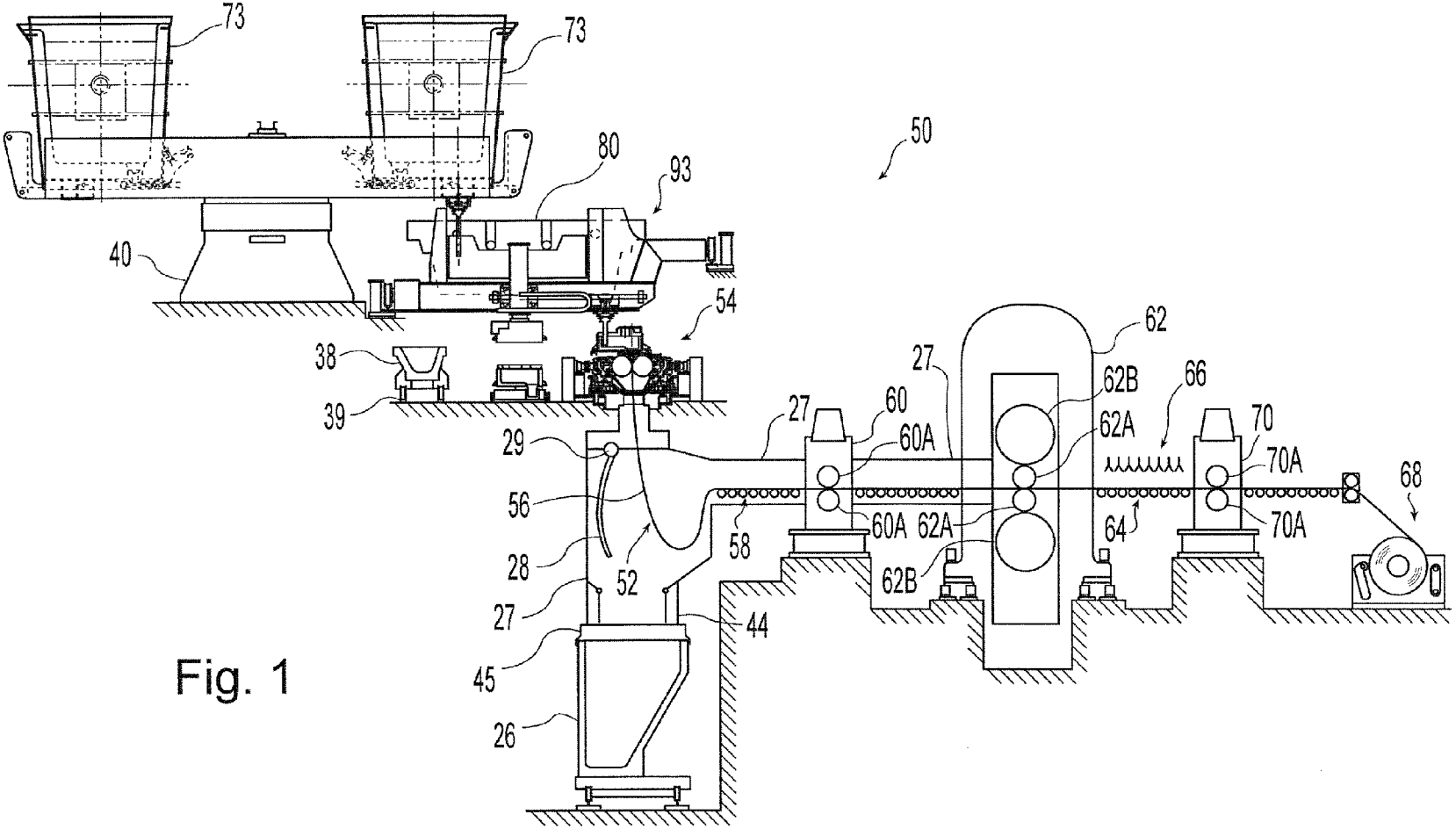
FIG. 1 is a diagrammatical side view of a twin roll caster of the present disclosure by which steel strip can be produced.
Figure 2:
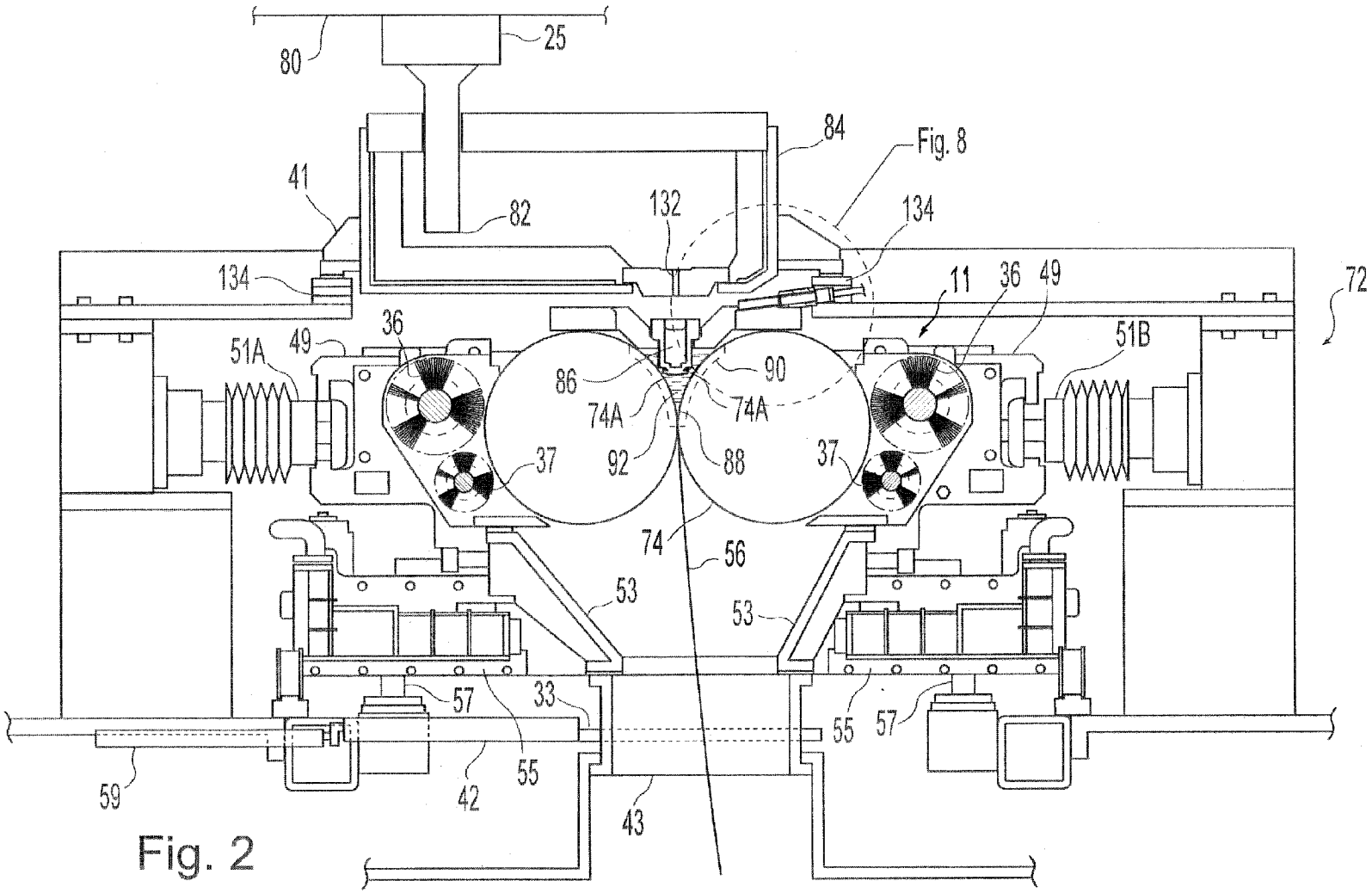
FIG. 2 is a partial sectional view through casting rolls mounted in a roll cassette in the casting position of the present disclosure.

Referring to FIGS. 1 and 2, a continuous strip steel casting apparatus and process 50 is illustrated as successive parts of a production line whereby steel strip can be produced. This production line includes a twin roll caster denoted generally as 54 which produces as-cast steel strip 56 that passes in a transit path 52 across a guide table 58 to a pinch roll stand 60 comprising pinch rolls 60A.

The thickness of the as-cast strip is considered as the strip thickness at the exit from the twin roll caster, and the thickness of the cast strip is generally measured downstream of the exit of the strip from the casting rolls before the pinch rolls by an x-ray gage, recognizing that the thickness of the strip can be subsequently reduced by the pinch rolls and, optionally, downstream hot rolling mill. This measured thickness is generally reported as the as-cast thickness of the strip.

Upon exiting the pinch roll stand 60, the thin cast strip optionally may pass through a hot rolling mill 62, where the cast strip is hot rolled to reduce its thickness to a customer-specified thickness, improve the strip surface, and improve the strip flatness. The hot rolling mill 62 comprises a pair of reduction rolls 62A and backup rolls 62B. The rolled strip passes onto a run-out table 64 on which the strip may be force cooled by water jets 66 or other suitable means, and by convection and radiation. In any event, the rolled strip may then pass through a second pinch roll stand 70 comprising a pair of pinch rolls 70A, and then to a coiler 68.

Figure 5:
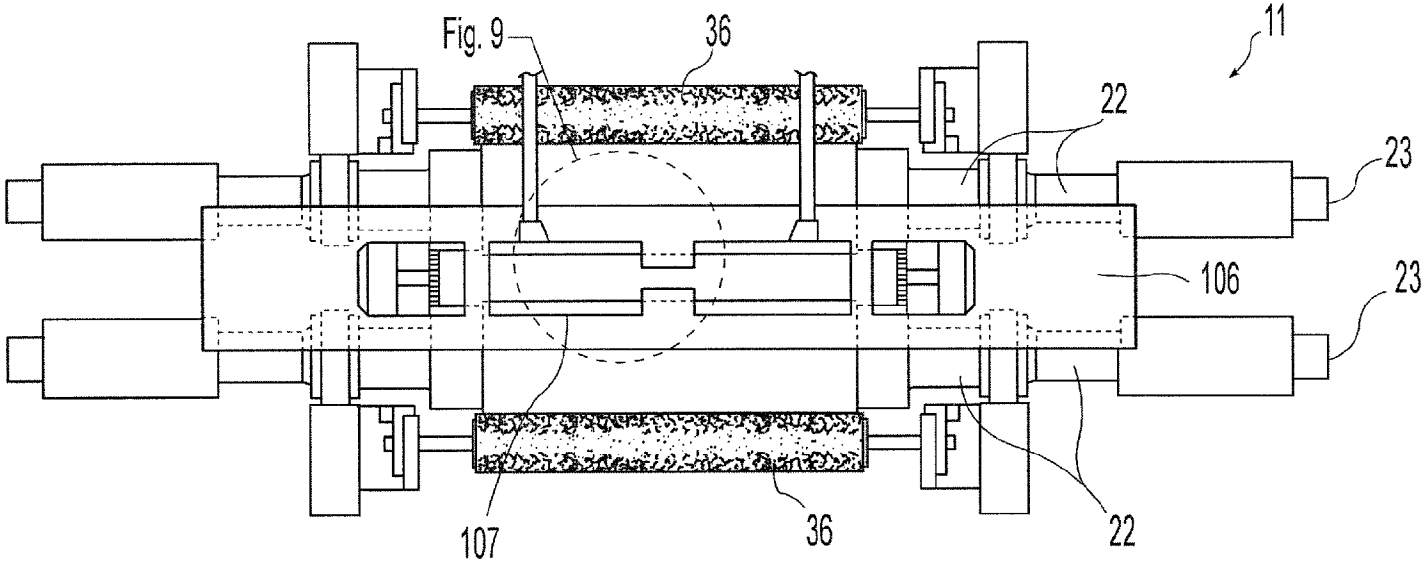
FIG. 5 is a diagrammatical plan view of the roll cassette of FIG. 3 removed from the caster.

Referring now to FIGS. 2 and 5, a twin roll caster 54 comprises a main machine frame 72 that stands up from the factory floor and supports a pair of laterally positioned casting rolls 74 (with a nip 88 between them) mounted modularly in a roll cassette 11. The casting rolls 74 are mounted in the roll cassette 11 for ease of operation and movement as described below. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls as described herein.

As shown in FIGS. 1 and 2, the pair of counter-rotatable casting rolls 74 have casting surfaces 74A laterally positioned to form the nip 88 there between. Molten metal is supplied during a casting operation from a ladle 73 to a tundish 80, through a refractory shroud 82 to a distributor 84 and thence through a metal delivery nozzle 86, core nozzle, positioned between the casting rolls 74 in a casting area above the nip 88. Molten metal thus delivered to the nip 88 forms a casting pool 92 of molten metal supported on the casting roll surfaces 74A above the nip 88. This casting pool 92 is confined at the ends of the rolls by a pair of side dams 90 (shown in dotted line in FIG. 2), which are positioned at the ends of the rolls by a pair of thrusters (not shown) comprising hydraulic cylinder units connected to side plate holders. It will be appreciated that biasing force provided by the hydraulic cylinders may be alternatively provided by, for example, springs or a servo mechanism. The upper surface of casting pool 92 (generally referred to as the "meniscus" level) will generally rise above the lower end of the delivery nozzle 86 so that the lower end of the delivery nozzle 86 is immersed within this casting pool 92. The casting area includes the addition of a protective atmosphere above the casting pool 92 to inhibit oxidation of the molten metal in the casting area.

Figure 6:
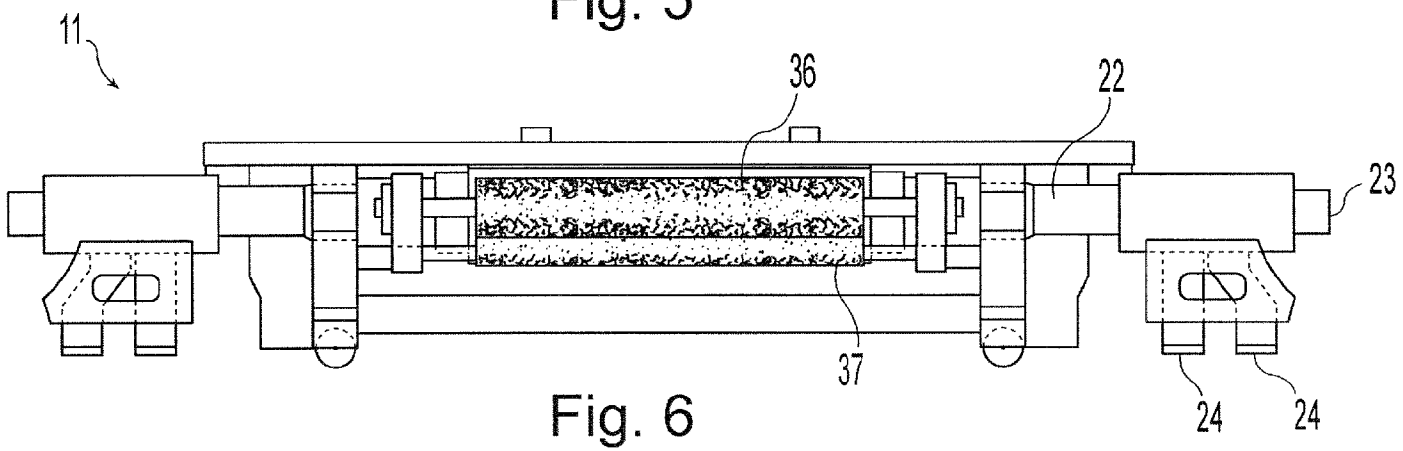
FIG. 6 is a diagrammatical side view of the casting rolls mounted in a roll cassette of FIG. 3 removed from the caster.

The side dams 90 may be mounted on and actuated by side dam holders (not shown) positioned one at each end of the roll assembly and moveable toward and away from one another. The side dam holders and side dams 90 may be positioned on a core nozzle plate 106 mounted on the roll cassette 11 so as to extend horizontally above the casting rolls, as shown in FIGS. 5 and 6. The core nozzle plate 106 is positioned beneath the distributor 84 in the casting position and has a central opening 107 to receive the metal delivery nozzle 86. The metal delivery nozzle 86 may be provided in two or more segments, and at least a portion of each metal delivery nozzle 86 segment may be supported by the core nozzle plate 106. The outer end of each metal delivery nozzle 86 is supported by a bridge portion (not shown) positioned adjacent the side dams 90 and capable of supporting and moving the delivery nozzle 86 during casting.

The ladle 73 typically is of a conventional construction supported on a rotating turret 40. For metal delivery, the ladle 73 is positioned over a movable tundish 80 in the casting position to fill the tundish with molten metal. The movable tundish 80 may be positioned on a tundish car 93 capable of transferring the tundish from a heating station (not shown), where the tundish is heated to near a casting temperature, to the casting position. The tundish car 93 may be movable along a guide such as rails (not shown) extending between the heating station and the casting position.

The movable tundish 80 may be fitted with a slide gate 25, typically actuable by a servo mechanism, to allow molten metal to flow from the tundish 80 through the slide gate 25, and then through the refractory shroud 82 to the transition piece or distributor 84 in the casting position. From the distributor 84, the molten metal flows to the delivery nozzle 86 positioned between the casting rolls 74 above the nip 88. The distributor 84 carries mounting brackets 41 for supporting the distributor on the caster frame when the distributor 84 is in the casting position.

Casting rolls 74 are internally water cooled so that as the casting rolls 74 are counter-rotated, shells solidify on moving casting roll surfaces 74A as the casting surfaces move into contact with and through the casting pool 92 with each revolution of the casting rolls 74. The shells are brought together at the nip 88 between casting rolls 74 to produce the solidified thin cast strip product 56 delivered downwardly from the nip 88. The twin roll caster 54 may be of the kind which is illustrated and described in some detail in U.S. Pat. Nos. 5,184,668 and 5,277,243 or U.S. Pat. No. 5,488,988.

At the start of the casting operation, a short length of imperfect strip is typically produced as casting conditions stabilize. After continuous casting is established, the casting rolls are moved apart slightly and then brought together again to cause this leading end of the strip to break away forming a clean head end of the following cast strip. The imperfect material drops into a scrap receptacle 26, which is movable on a scrap receptacle guide. The scrap receptacle 26 is located in a scrap receiving position beneath the caster and forms a lower part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 56 onto the guide table 58 that feeds it to the pinch roll stand 60. The apron 28 is then retracted back to its hanging position to allow the cast strip 56 to hang in a loop beneath the casting rolls in enclosure 27 before it passes to the guide table 58 where it engages a succession of guide rollers.

An overflow container 38 may be provided beneath the movable tundish 80 to receive molten material that may spill from the tundish. As shown in FIG. 1, the overflow container 38 may be movable on rails 39 or another guide such that the overflow container 38 may be placed beneath the movable tundish 80 as desired in casting locations. Additionally, an overflow container (not shown) may be provided for the distributor 84 adjacent the distributor.

The sealed enclosure 27 is formed by a number of separate wall sections that fit together at various seal connections to form a continuous enclosure wall that permits control of the atmosphere within the enclosure. Some or all of the wall sections may be internally water cooled. Additionally, the scrap receptacle 26 may be capable of attaching with the enclosure 27 so that the enclosure is capable of supporting a protective atmosphere immediately beneath the casting rolls 74 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be a complete seal so as to prevent leakage, but rather is usually less than a perfect seal as appropriate to allow control and maintain the protective atmosphere within the enclosure 27 as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 is in selective engagement with the upper edges of the scrap receptacle 26, which is illustratively in a rectangular form, so that the scrap receptacle may be in sealing engagement with the enclosure 27. The rim portion may be movable away from or otherwise disengage from the scrap receptacle to disengage the seal and allow the scrap receptacle to move from the scrap receiving position.

As shown in FIG. 1, a scrap receptacle is placed beneath the casting position in the scrap receiving position to receive scrap and other by-products of the casting process in the receptacle during casting. When the scrap receptacle 26 is in the scrap receiving position, the rim portion 45 of the enclosure wall is in sealing engagement with the upper edges of the scrap receptacle 26. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion 43 supporting a protective atmosphere immediately beneath the casting rolls in the casting position. The upper collar portion 43 may be moved between an extended position capable of supporting the protective atmosphere immediately beneath the casting rolls and an open position enabling an upper cover 42 to cover the upper portion of the enclosure 27. The upper cover 42 may be movable along guide 33 by cover actuator 59 as shown on FIG. 2. When the casting rolls 74 are in the casting position, the upper cover 42 is moved uncovering the upper portion of the enclosure 27, and the upper collar portion 43 is moved to the extended position closing the space between a housing portion 53 adjacent the casting rolls 74 and the enclosure 27, as shown in FIG. 2. The upper collar portion 43 may be provided within or adjacent the enclosure 27 and adjacent the casting rolls, and may be moved by a plurality of actuators (not shown) such as servo-mechanisms, hydraulic mechanisms, pneumatic mechanisms, and rotating actuators. The twin roll caster illustratively may be of the kind described in U.S. patent application Ser. No. 12/050,987, and reference may be made to that for appropriate constructional details.

The casting rolls 74 are assembled modularly in a roll cassette 11 for rapid installation of the casting rolls 74 in the caster in preparation for casting strip, and for rapid set up of the casting rolls 74 for installation. The roll cassette 11 may comprise a cassette frame 55, roll chocks 49 capable of supporting the casting rolls 74 and moving the casting rolls on the cassette frame. The housing portion 53 may also be positioned beneath the casting rolls to enable support of a protective atmosphere in the enclosure 27 immediately beneath the casting rolls during casting. The housing portion 53 is positioned corresponding to and sealingly engaging an upper portion of the enclosure 27 for enclosing the cast strip in a protective atmosphere below the nip 88.

A roll chock positioning system is provided on the main machine frame 72 having two pairs of positioning assemblies 51A, 51B that can be rapidly connected to the roll cassette 11. The roll cassette 11 is adapted to enable movement of the casting rolls on the cassette frame 55, and includes positioning assemblies 51A, 51B to provide forces resisting separation of the casting rolls during casting. The positioning assemblies 51A, 51B may include actuators such as mechanical roll biasing units or servo-mechanisms, hydraulic or pneumatic cylinders or mechanisms, linear actuators, rotary actuators, magnetostrictive actuators or other devices for enabling movement of the casting rolls and resisting separation of the casting rolls during casting.

Figure 7:
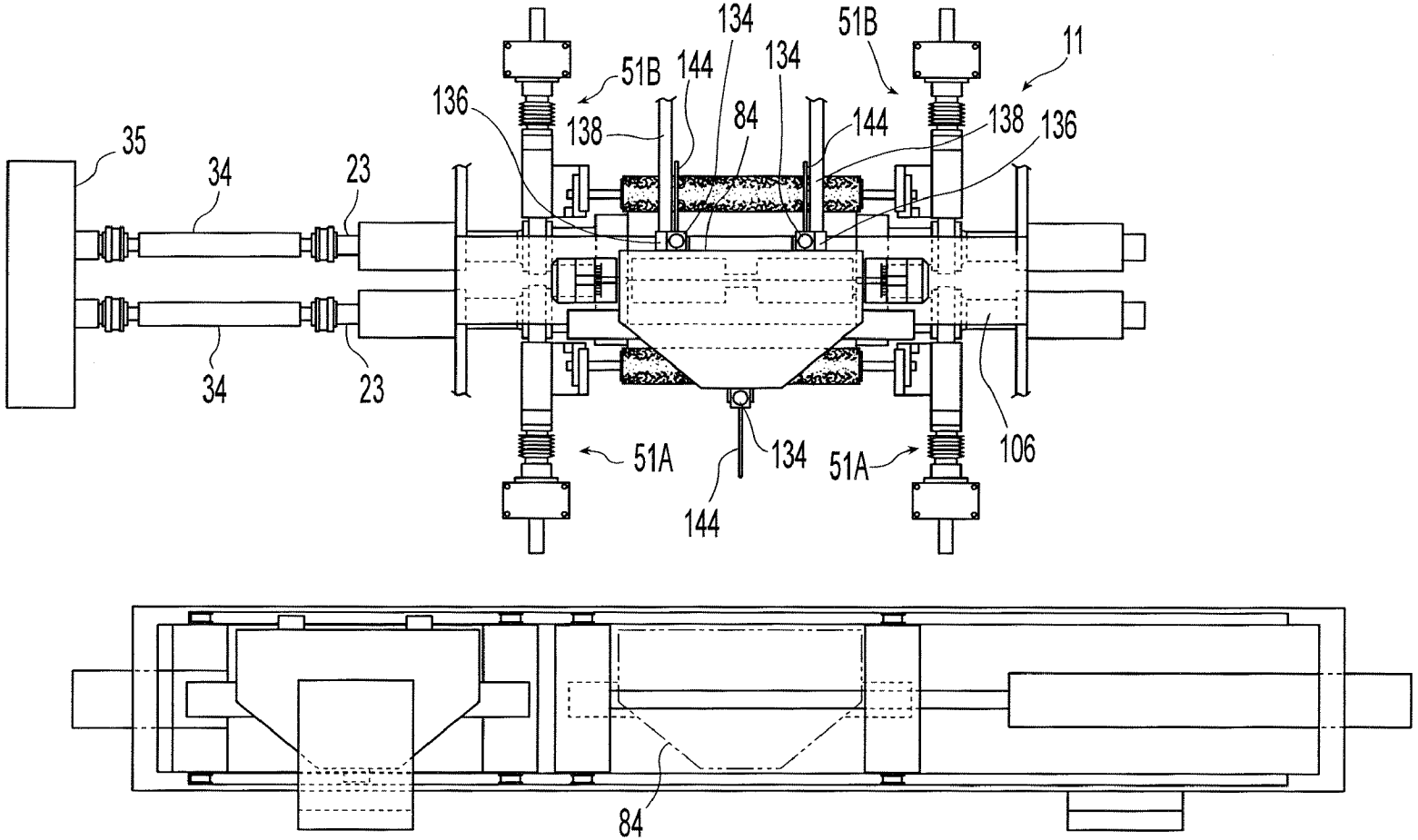
FIG. 7 is a diagrammatical plan view of casting rolls mounted in a roll cassette in a casting position with a distributor shift car.

The casting rolls 74 include shaft portions 22, which are connected to drive shafts 34, illustrated in FIG. 7, through end couplings 23. The casting rolls 74 are counter-rotated through the drive shafts by an electric motor (not shown) and transmission 35 mounted on the main machine frame. The drive shafts can be disconnected from the end couplings 23, enabling the casting rolls to be changed without dismantling the actuators of the positioning assemblies 51A, 51B. The casting rolls 74 have copper peripheral walls formed with an internal series of longitudinally extending and circumferentially spaced water cooling passages, supplied with cooling water through the roll ends from water supply ducts in the shaft portions 22, which are connected to water supply hoses 24 through rotary joints (not shown). The casting rolls 74 may be about 500 millimeters in diameter, or may be up to 1200 millimeters or more in diameter. The length of the casting rolls 74 may be up to about 2000 millimeters, or longer, in order to enable production of strip product of about 2000 millimeters width, or wider, as desired, in order to produce strip product approximately the width of the rolls. Additionally, the casting surfaces may be textured with a distribution of discrete projections, for example, as random discrete projections as described and claimed in U.S. Pat. No. 7,073,565. The casting surface may be coated with chrome, nickel, or other coating material to protect the texture.

As shown in FIG. 2, cleaning brushes 36 are disposed adjacent the pair of casting rolls 74, such that the periphery of the cleaning brushes 36 may be brought into contact with the casting surfaces 74A of the casting rolls 74 to clean oxides from the casting surfaces during casting. The cleaning brushes 36 are positioned at opposite sides of the casting area adjacent the casting rolls 74, between the nip 88 and the casting area where the casting rolls enter the protective atmosphere in contact with the molten metal casting pool 92. Optionally, a separate sweeper brush 37 may be provided for further cleaning the casting surfaces 74A of the casting rolls 74, for example at the beginning and end of a casting campaign as desired.

Once in operating position, the casting rolls 74 are secured with the positioning assemblies 51A, 51B connected to the roll cassette 11, drive shafts connected to the end couplings 23, and a supply of cooling water coupled to water supply hoses 24. A plurality of jacks 57 may be used to further place the casting rolls in operating position. The jacks 57 may raise the roll cassette 11 in the casting position, as shown in FIG. 2. Alternately, the roll cassette may be lowered or laterally moved in the casting position to place the casting rolls in operating position. The positioning assemblies 51A, 51B may move at least one of the casting rolls 74 to provide a desired nip 88 between the casting rolls in the casting position.

Each casting roll 74 may be mounted in the roll cassette 11 to be capable of moving toward and away from the nip 88 for controlling the casting of the strip product. The positioning assemblies 51A, 51B include actuators capable of moving each casting roll toward and away from the nip 88 as desired. Position sensors are provided capable of sensing the location of the casting rolls and producing electrical signals indicative of the position of each casting roll. A control system is provided capable of receiving the electrical signals indicating the casting roll's position and causing the actuators to move the casting rolls into desired position for casting metal strip. The apparatus for continuously casting strip may have separate actuators capable of moving each casting roll independently.

Figure 3:
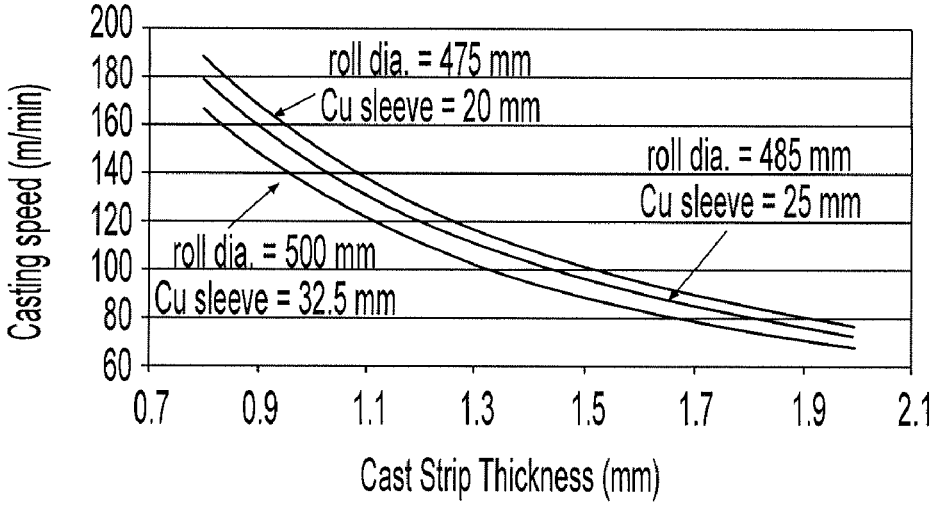
FIG. 3 is a graph showing typical maximum permitted casting speeds for casting rolls for differing strip thicknesses.

Each casting roll 74 may be formed with an outer copper alloy sleeve defining the casting surfaces 74A. The casting surfaces 74A are machined with an initial crown to allow for thermal expansion when the rolls are in use and provide strip flatness and strip profile. A different crown may be required according to the casting speed and steel composition cast. The target casting speed, and in turn throughput from the twin roll caster, is governed by the maximum temperature which can be permitted at the casting surfaces 74A, and generally may be of the order of about 350° C. to 400° C. when the copper sleeve is made of copper chromium zirconium (CuCrZr) alloy. It has been found that 385° C. is a desirable operating temperature within this range when the copper sleeve is made of copper chromium zirconium (CuCrZr) alloy. When the circumferential copper sleeve is made of copper beryllium (CuBe) alloy, a desireable operating temperature may be about 466° C. This operating temperature depends on the characteristics of the casting roll 74, primarily the roll diameter and the thickness of the copper sleeve, and the heat flux. FIG. 3 is a graph showing typical maximum permitted casting speeds for varying cast strip thicknesses for casting rolls of various diameters and sleeve thicknesses.

The as-cast thickness of the strip can be controlled by changing the depth of the casting pool. The caster may continue to operate at a substantially constant throughput at or close to a desired temperature for the particular casting rolls 74, without causing over-heating and undue wear of the casting surfaces 74A. The resulting flexibility in varying the as-cast thickness provided by operation of the in-line rolling mill to achieve a thickness reduction improves strip surface quality and final shape of the strip. Generally a reduction in the range 10% to 50% may be provided. A standard reduction within this range may be defined as the default and thereafter assumed to be the desired reduction when processing customer orders. For example, a reduction of the order of 15% will be appropriate and could be defined as the standard reduction. Of course, customers could choose a reduction other than any such standard reduction, and may even desire a reduction outside the general range.

A typical methodology for processing customer orders and operating the strip casting line accordingly is as follows:

1. Customer provides product thickness specification.
2. Calculate cast thickness=customer thickness+15%. This is required to produce after casting a strip surface of desired quality via rolling mill+roll-bite lubrication.
3. Calculate rolling mill force set point to achieve targeted final thickness from cast thickness.

4. For the calculated cast thickness, determine the target casting speed (which may be related to maximum caster throughput which can still satisfy the desired roll surface temperature for a given casting roll diameter) (see FIG. 3). This gives a target casting speed for the casting roll speed controller.
5. Having determined the target casting speed, the target pool level is determined using equation 1 (Eq. 1) below. This gives the target pool level for the pool level controller:

$$R\sin^{-1}\left(\frac{h}{R}\right) = u * \frac{d^2}{k^2}$$

or, solving for h:

$$h = R\sin\left[\frac{u}{R} * \frac{d^2}{k^2}\right] \quad \text{(Eq. 1)}$$

where, h=pool level (mm),
R=casting roll radius (mm),
d=half strip thickness (mm),
k=roll k-factor ($mm/min^{0.5}$),
u=casting speed (mm/min).

The k-factor is based on the solidification rate of the metal in accordance with the formula:

$d=k\sqrt{t}$, or $k=d\sqrt{t}$ where d is the half strip thickness, and t is the solidification or contact time of metal on a rotating casting roll between the pool meniscus level and the nip. In determining the target pool level h, the k-factor may be a desired or selected value, such as an empirical k-value, or a calculated k-value based on desired parameters such as a desired or determined contact or solidification time t.

It will be appreciated that this methodology also allows, among other things:

1. Expanded range of cast strip thicknesses that can be produced using a single machined crown and roll texture in the casting rolls. The number of casting roll sets required to produce a given product mix is thus reduced, in turn reducing working capital.
2. Production of thin strip with acceptable shape as cold roll replacement, while at the same time preserving the cast microstructure and enabling the production of a large range of mechanical properties from a molten steel composition of a given chemistry specification.
3. Constant (typically near maximum allowable) caster throughput for different cast strip thicknesses without over heating the casting rolls.
4. Change of thicknesses on a coil within a particular sequence, thus reducing the lead times to fulfill customer orders.

To illustrate, if a customer orders 1.0 mm thick strip, the strip caster would be operated to produce an as-cast thickness of say 1.15 mm, and the rolling mill would be operated to reduce the thickness to 1.0 mm and improve strip surface quality. From FIG. 3, the target casting speed would be about 110 m/min for a 500 mm diameter roll. This determination is influenced by the maximum temperature that the casting rolls can tolerate for a reasonable operating life, which is generally of the order of about 350° C. to 400° C. If the thickness of the circumferential copper sleeve of the casting roll 74 is reduced, the target speed (to achieve the same maximum copper surface temperature) may be higher. For a target speed of 110 m/min and a typical roll k-factor of 16.25 (which can vary with the texture of the casting surface), Equation No. 1 can be used to determine a target pool height of 130 mm, which becomes the target pool level control for this particular customer order.

Figure 4:
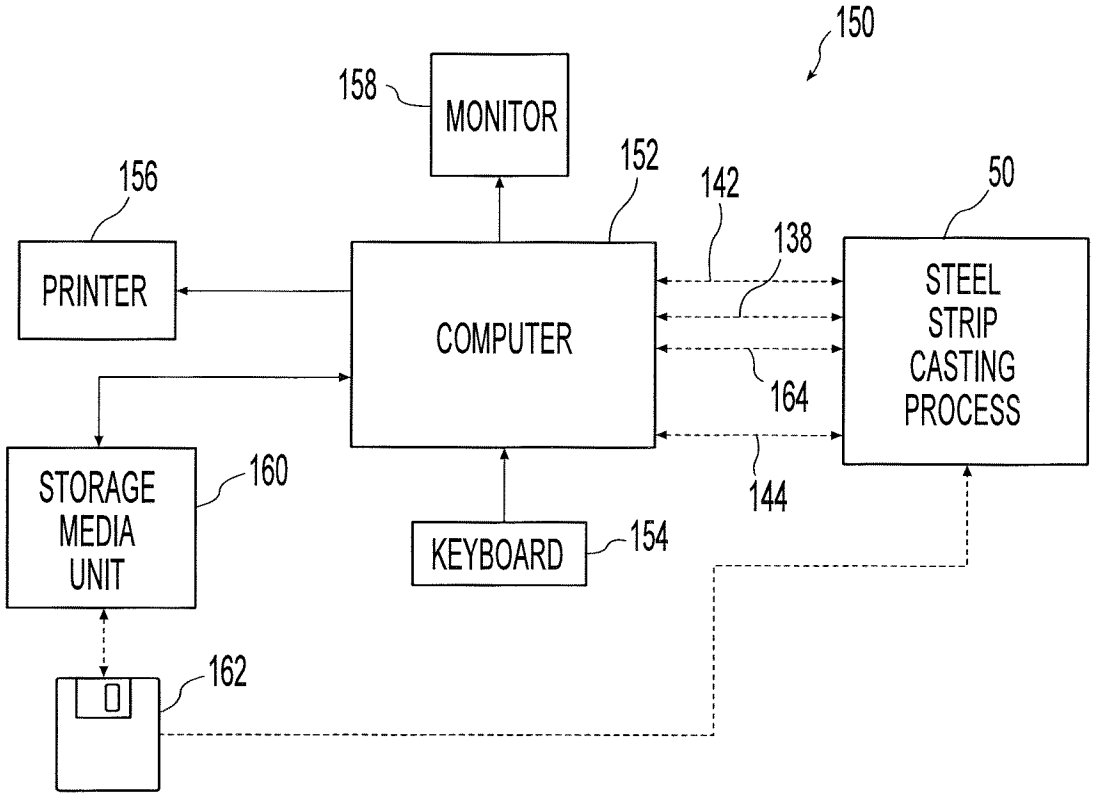
FIG. 4 diagrammatically illustrates a computer system into which details of customer orders can be entered and processed to determine casting speed targets and casting pool depth targets for controlling the casting process, as well as controlling other process parameters to meet customer-specified properties.

In accordance with the present invention, customer orders for steel strip may be entered into a general purpose computer system, such as computer system 150 of FIG. 4, and processed to determine the casting speed and pre-depth targets as described above.

Referring to FIG. 4, the computer system 150 includes a general purpose computer 152 that may be a conventional desktop personal computer (PC), or a laptop or notebook or handheld computer, or other general purposed computer or combination of computers configured to operate in a manner to be described subsequently. For example, computer system 150 may comprise a local-area or wide-area network of computers 152. Computer system 150 further comprises various input and output devices.

Such input devices allow for entering information relating to the customer's order, and may include a conventional keyboard 154 electrically connected to computer 152. Such input information may also be entered via input devices such as a bar-code scanner, an optical-character-recognition scanner, a voice recognition device, a character-recognition pad, another computer or computer system, or other suitable input device. Customer parameters also may be inputted and controlled directly from a remote input device via, for example, an internet, via a modem, or other suitable connection. Input information may also be retrieved from a connected storage device 160, which may be a disk drive for use with a floppy disk 162, or a CD or DVD drive, or other suitable storage media unit.

Such a storage device 160 may also be an output device. Thus, computer 152 is electrically connected to storage media unit 160, wherein computer 152 is configured to store information to, and retrieve information from, storage unit 160.

The computer system 150 may also include any one or combination of other suitable output devices, such as a printer, a visual display device such as a monitor, another computer or system of computers, or one or more process controllers. For example, computer 152 may be electrically connected to a printer 156, wherein computer 152 may be configured to print a set of process parameters in the form of a process change report or similar report, wherein the process change report sets forth the targets for controlling the casting speed and casting pool depth.

Computer 152 also may be electrically connected to a display monitor 158, wherein computer 152 may be configured to display a set of process parameters in the form of a process change report or similar report, wherein the process change report sets forth the process parameters and/or targets for controlling the continuous steel strip casting process. An operator of the continuous steel strip casting process may view the process change report displayed on the monitor 158, in addition to or in place of a printed report, and may make corresponding physical changes to the continuous steel strip casting process to thereby produce the customer-ordered steel strip product.

Computer system 150 may also directly control the strip casting process 50. For example, two-way connection 164 illustratively connects computer 152 directly to the various controllers described herein. The computer 152 may thereby directly make corresponding physical changes to the continuous steel strip casting process to thereby produce the customer-ordered steel strip product. In addition, the computer 152 may monitor and receive feedback from the process via digital signals over connection 164 and may make adjustments accordingly, or allow the operator to make adjustments.

One skilled in the art will recognize that the depicted and described connections between the various components of the computer system 150 may be hard-wire connections, radio frequency connections, and/or infrared or other optical or electromagnetic connections or any combination thereof.

Computer system 150, or controller, may also be operated to produce and/or control other process parameters, targets, and/or set points for controlling the continuous steel strip casting process in accordance with customer orders as is more fully disclosed in U.S. Pat. No. 6,581,672. Such parameters may, for example, be used to control operation of the water sprays 66 to control cooling of the strip in order to provide customer-specified yield strength properties in the strip.

The flow of molten metal from the metal supply system into the casting pool may be controlled by controlling the flow of molten metal from the tundish 80 to the distributor 84. The slide gate 25 may be variably actuable to selectively provide increased or decreased flow into the distributor 84 as desired. The flow rate of molten metal from the distributor 84 to the delivery nozzle 86 is related to the flow area of one or more apertures 132 through which molten metal flows from the distributor 84 and the height of the molten metal in the distributor above the apertures 132. The flow of molten metal from the distributor 84 to the delivery nozzle 86 may be controlled by selecting the size of the one or more apertures 132 through which the molten metal flows from the distributor to the delivery nozzle, and controlling the height of the molten metal in the distributor. For example, the height of the molten metal in the distributor 84 may be determined by sensing the weight of metal in the distributor. The weight of the molten metal in the distributor 84 may be used to determine and control the height of the molten metal in the distributor 84 for controlling the flow rate of molten metal through the aperture 132. Other methods may be used to determine the height of molten metal in the distributor 84, such as laser measuring device, cameras, radiation probe, microwave probe, or other sensors capable of sensing the height of molten metal in the distributor 84. The sensors capable of sensing the height of the molten metal in the distributor produce electrical signals indicative of the height of the molten metal in the distributor, which may be used to control the flow of molten metal.

A plurality of force sensors, or load cells 134 may be provided to determine the amount of metal in the distributor 84. As shown in FIG. 7, three load cells may be provided beneath the distributor 84 capable of sensing the weight of the molten metal in the distributor and producing electrical signals indicative of the weight of the molten metal in the distributor. The load cells 134 may be positioned between the mounting brackets 41 and a portion of the machine frame 72.

The computer system 150, or controller, may be provided capable of receiving the electrical signals indicative of the weight of the molten metal in the distributor 84 or receiving the electrical signals indicative of the height of the molten metal in the distributor 84. The controller may further process the electrical signals and control the flow of molten metal from the tundish 80 to the distributor 84 responsive to the electrical signals indicative of the height and/or weight of molten metal in the distributor. For example, the computer system 150 may receive the electrical signals from the load cells 134 after the distributor 84 is placed in the casting position but before molten metal begins to flow from the tundish 80 to determine the weight of the distributor. Then, the computer system 150 may continue to receive the electrical signals from the load cells 134 as molten metal flows from the tundish 80 into the distributor 84. The computer system 150, or controller, may process the signals including subtracting the weight of the distributor when empty from the weight of the distributor containing molten metal. The controller may further process the electrical signals from the load cells 134 to determine whether the sensed weight is within a desired range. The desired weight of molten metal in the distributor 84 may be selected by the weight of molten metal providing a desired height of molten metal in the distributor and the desired flow rate through the aperture 132.

For another example, the computer system 150 may receive the electrical signals indicative of the height of the molten metal in the distributor from a sensor (not shown), such as a laser measuring device, camera, radiation probe, microwave probe, or other sensor, as molten metal flows from the tundish 80 into the distributor 84. The computer system 150, or controller, may process the signals to determine whether the sensed height is within a desired range. The desired height of molten metal in the distributor 84 may be determined using the flow area of apertures 132 and the desired flow rate through the apertures 132.

During casting, if the electrical signals indicative of the height or weight of the molten metal in the distributor indicate greater or less than a desired amount, the controller or an operator may cause the slide gate 25 to decrease or increase the flow of metal from the tundish 80 to the distributor 84, as desired. Additionally, during the casting operation the aperture 132 through which the molten metal flows from the distributor 84 to the delivery nozzle 86 may wear forming a larger aperture and thereby increasing flow. The controller receiving electrical signals from the load cells 134 may be used to maintain the mass rate of flow of molten metal through the distributor aperture 132 as desired.

A data conduit 144 may provide a two-way connection such as a signal cable or fiber optic connection between each load cell 134 and the computer system 150, or controller. The force sensors, or load cells 134, may be connected to the computer system 150 in parallel, or may be connected to the computer system 150 separately. As shown in FIG. 7, three load cells may be provided. In the embodiment of FIG. 7, two load cells on one side of the distributor may be connected to the controller in parallel, and the third load cell on the opposite side may be connected to the controller separately.

Figure 8:
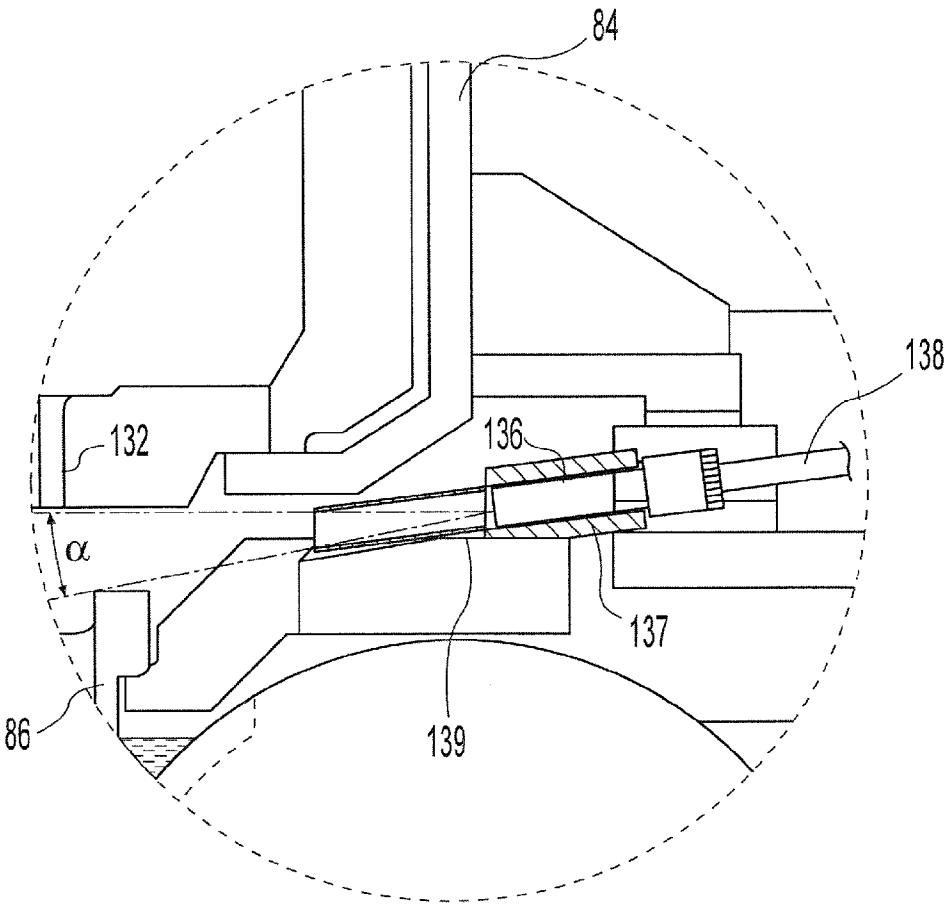
FIG. 8 is a detail view identified as detail 9 in FIG. 2 showing placement of a stream camera of the present disclosure.
Figure 9:
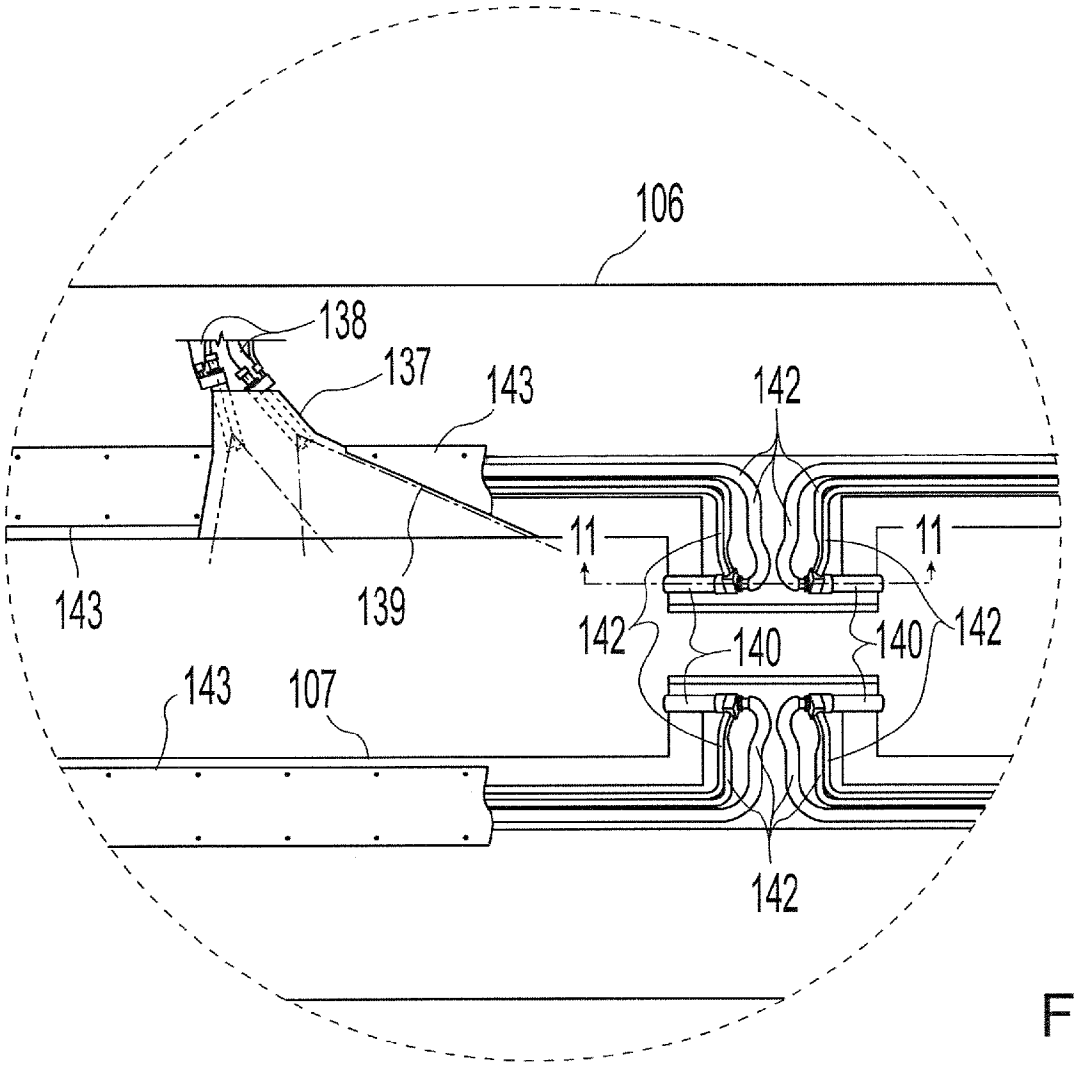
FIG. 9 is a detail view identified as detail 10 in FIG. 5 of a core nozzle plate showing placement of cameras of the present disclosure with covers partially removed.

Image sensors, such as stream cameras 136, may be provided to monitor the flow of metal from the distributor 84 to the delivery nozzle 86. As shown in FIGS. 8 and 9, stream image sensors 136 may be provided capable of sensing an image of the flow of molten metal from the metal supply system into the delivery nozzle 86 in a plurality of locations in the casting area. The computer system 150 may display the sensed images to the operator. Then, the flow of molten metal from the metal supply system into the delivery nozzle 86 may be controlled responsive to the sensed images of the flow of molten metal into the delivery nozzle 86. This may involve shutting down of the casting campaign where necessary.

The stream image sensors 136 may be water cooled cameras capable of operating in high temperature environments. Alternately or in addition, the stream cameras may be provided with fiber optic sensors (not shown) directed into, for example, the triple point area of the casting pool 92. The fiber optic sensors may include fiber optic lenses with stream image sensors 136. In any case, fiber optics may enable the stream cameras to operate removed from the temperatures of the molten metal. A conduit 138 directs cooling lines to each stream camera 136 and provides a two-way connection such as a signal cable or fiber optic connection between the stream cameras and the controller, computer system 150.

The stream image sensors 136 may be positioned between the core nozzle plate 106 and the distributor 84. As shown in FIGS. 8 and 9, the image sensors 136 may be provided with a camera support 137 positioned on the core nozzle plate 106. Further, a camera shroud 139 may be provided directed into the casting area.

The stream image sensors 136 may produce electrical signals corresponding to the sensed images of the flow of molten metal into the delivery nozzle 86 in each of the plurality of locations or in selected locations. The stream cameras 136 may provide electrical signals corresponding to a series of images, one after another such as a video, providing a desired number of images per second. The electrical signals from the stream cameras 136 may be analog signals or digital signals as desired.

The controller, computer system 150 is capable of receiving the electrical signals indicative of the flow of molten metal into the casting pool 92 in each of the plurality of locations or in selected locations, and controlling the flow of molten metal from the metal supply system into the delivery nozzle 86 responsive to the electrical signals indicative of the flow of molten metal into the delivery nozzle. For example, the computer system 150 or an operator may determine from the images that the flow of molten metal from the distributor 84 is directed outside of a desired area in the delivery nozzle 86. Further, the computer system 150 or an operator may determine from the images that at least a portion of the metal supply system is operating outside of a desired operating parameter, for example a delivery nozzle having restricted or misdirected flow, or a component near the end of its service life. Then, at least a portion of the metal supply system may be maintained responsive to the sensed images of the flow of molten metal into the delivery nozzle, such as changing position of sensors, unplugging flow apertures, replacing at least a portion of the metal supply system, or other corrective actions.

The selected depth of the casting pool 92 may be monitored and controlled by images of the casting pool from image sensors in a plurality of locations indicative of the casting pool depth in each of the plurality of locations or in selected locations, displaying the sensed images to an operator, and controlling a flow of molten metal from the metal supply system into the casting pool 92 responsive to the sensed images indicative of the casting pool depth.

Figure 10:
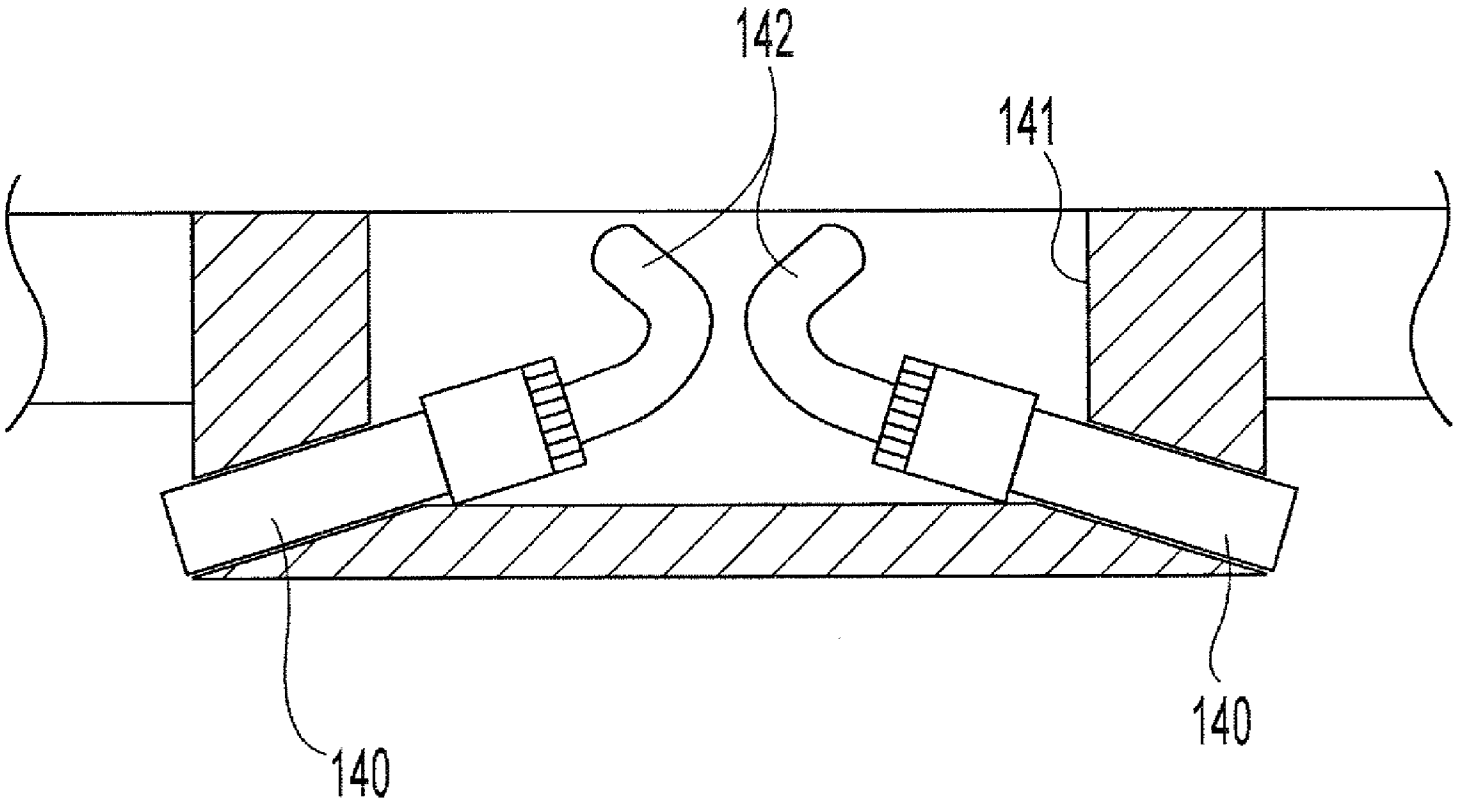
FIG. 10 is a partial sectional view through the section marked 10-10 in FIG. 9 showing placement of pool cameras of the present disclosure.

Pool image sensors 140, such as pool cameras 140, may be provided in a plurality of locations to monitor the casting pool depth. As shown in FIGS. 9 and 10, pool image sensors 140 may be provided sensing images of the meniscus of the casting pool 92 in a plurality of locations in the casting area indicative of the casting pool depth in the plurality of locations. For example, pool cameras 140 may be provided in each of the four quadrants of the casting pool 92. The computer system 150 may display the sensed images to the operator. Then, the flow of molten metal from the metal supply system into the delivery nozzle 86 may be controlled responsive to the sensed images indicative of the casting pool depth. To control the flow to the delivery nozzle 86, the controller or an operator may cause the slide gate 25 to decrease or increase the flow of metal from the tundish 80 to the distributor 84, as desired, thereby decreasing or increasing the rate of flow from the distributor 84 to the delivery nozzle 86.

The pool image sensors 140 may be water cooled cameras capable of operating in high temperature environments. Alternately or in addition, the pool cameras 140 may be provided with fiber optic lenses directed into the casting area, notably in the triple point area adjacent the side dams 90, and enabling the pool cameras to operate removed from the temperatures of the molten metal. A conduit 142 directs cooling lines to each pool camera 140 and provides a two-way connection such as a signal cable or fiber optic connection between the pool cameras and the controller, computer system 150.

The pool image sensors 140 may be positioned within or adjacent the core nozzle plate 106. As shown in FIGS. 9 and 10, the pool image sensors 140 may be provided with a camera support 137 positioned within a cavity 141 in the core nozzle plate 106. The cavity 141 may be closed by covers 143 to enclose and protect the conduit 142. Alternately or in addition, the pool cameras 140 may be positioned adjacent the side dams 90 supporting and moving the delivery nozzle 86, in the triple point area. Cameras in the triple point region may monitor and control irregular flows and contaminants such as solidified metal, called snake eggs, forming along the side dam/casting roll interface in the triple point region.

The pool image sensors 140 may be provided in a plurality of locations to produce separate electrical signals corresponding to the sensed images indicative of the casting pool depth in each of the plurality of locations or in selected locations. The pool cameras 140 may provide electrical signals corresponding to a series of images, one after another such as a video, providing a desired number of images per second. The electrical signals from the pool cameras 140 may be analog signals or digital signals as desired.

The controller, computer system 150, may be capable of receiving the separate electrical signals indicative of the casting pool depth in each of the plurality of locations or in selected locations, and controlling the flow of molten metal from the metal supply system into the casting pool responsive to one or more of the electrical signals. The computer system 150, or controller, may process the electrical signals to determine the casting pool depth in each of the plurality of locations or in selected locations, and display the casting pool depth to the operator for control of molten metal flow. Alternately or in addition, the controller may control the flow of molten metal from the metal supply system into the casting pool responsive to the determined casting pool depth.

For example, the controller may perform image processing to determine the position of the meniscus level on the casting roll surface by contrasting the color of the molten metal and the color of the casting roll. The position of the meniscus level relative to the pool image sensor 140 may be calibrated to the desired casting pool depth. Then, the controller may increase or decrease the flow of molten metal from the metal supply system into the casting pool responsive to the determined casting pool depth so the desired casting pool depth is maintained.

More particularly, for a target casting speed, a target casting pool depth may be selected to produce a cast strip of desired thickness when casting at the target casting speed. Then, the controller may determine the difference between the determined casting pool depth and the target casting pool depth, and control the flow of molten metal from the metal supply system into the casting pool responsive to the difference between the determined casting pool depth and the target casting pool depth.

Alternately or in addition, one or more sensed images of the casting pool 92 indicative of the casting pool depth may be displayed to an operator on a monitor display with a visual reference, such as a scale or line, over or adjacent the image on the display. The position of the meniscus level on the casting roll surface relative to the visual reference on the monitor display may control to the desired casting pool depth. The operator may increase or decrease the flow of molten metal from the metal supply system into the casting pool 92 responsive to the visual difference or distance between the image of the meniscus level relative to the casting roll surface 74A and the visual reference on the monitor display.

During the casting operation, the delivery nozzle 86 may cause differing flow patterns along the casting rolls. When electrical signals corresponding to the casting pool depth in a camera location indicates a casting pool depth different than that from other pool image sensors 140, an operator or the controller may remove the outlying electrical signals from the determined casting pool depth. Alternately, the operator or computer system 150 may select one or more pool image sensors to determine and to monitor the casting pool depth. Thus, the flow of molten metal from the metal supply system into the casting pool may be controlled responsive to one or a combination of the separate electrical signals from the pool image sensors 140.

A plurality of pool cameras 140 may be provided to enable selection of one or a combination of separate electrical signals indicative of desired sensed images of the casting pool depth in the desired locations to provide a determined casting pool depth. Then, the operator or the computer system 150 may control the flow of molten metal from the metal supply system into the casting pool responsive to the determined casting pool depth. The electrical signals indicative of the casting pool depth in two or more selected pool image sensors 140, in different locations, may be combined for providing the determined casting pool depth. The electrical signals or indicated casting pool depth from selected pool image sensor 140 locations may be averaged for providing the determined casting pool depth. Note that an operator or the controller may have the capability of changing the pool image sensors 140 used in averaging during the casting campaign depending on operating conditions.

Two pool image sensors 140 may be provided, positioned to determine the casting pool depth adjacent each casting roll 74. Alternately or in addition, as shown in FIG. 9, four pool cameras 140 may be provided in the center of the casting area, positioned to determine the casting pool depth in each quadrant of the casting pool 92. Pool image sensors 140 also may be operatively either directly or through fiber optic sensor positioned adjacent one or both side dams 90 monitoring the casting pool 92 at the end of the casting rolls 74, in the triple point area.

While the invention has been illustrated and described in detail with reference of the drawings and foregoing description, the same is to be considered as illustrative and not restrictive in character, it being understood that one skilled in the art will recognize, and that it is the applicants desire to protect, all aspects, changes and modifications that come within the spirit of the invention.

What is claimed is:

1. A method of continuously casting metal strip comprising:

assembling a pair of counter-rotatable casting rolls having casting surfaces laterally positioned to form a nip therebetween through which thin cast strip can be cast, and a metal supply system capable of delivering molten metal into a casting pool through a delivery nozzle above the nip;

forming a casting pool of molten metal supported on the casting surfaces above the nip to form a casting area;

sensing images of a flow of molten metal from the metal supply system into the delivery nozzle in a plurality of locations;

sensing images of the casting pool in a plurality of locations in the casting area indicative of the casting pool depth in the plurality of locations;

displaying the sensed images of the flow of molten metal in a plurality of locations and of the casting pool in a plurality of locations; and controlling the flow of molten metal from the metal supply system into the delivery nozzle and the casting pool responsive to the sensed images indicative of the casting pool depth.

2. The method of continuously casting metal strip as claimed in claim 1 further comprising the steps of:

producing separate electrical signals corresponding to the sensed images indicative of the casting pool depth in each of the plurality of locations;

receiving the separate electrical signals indicative of the casting pool depth in each of the plurality of locations; and controlling the flow of molten metal from the metal supply system into the casting pool responsive to one or more of the electrical signals.

3. The method of continuously casting metal strip as claimed in claim 2 further comprising:

processing the electrical signals to determine the casting pool depth and displaying the casting pool depth to the operator.

4. The method of continuously casting metal strip as claimed in claim 3 comprising in addition the steps of:

selecting one or a combination of the separate electrical signals indicative of desired sensed images of the casting pool depth in desired locations for providing the determined casting pool depth; and controlling the flow of molten metal from the metal supply system into the casting pool responsive to the determined casting pool depth.

5. The method of continuously casting metal strip as claimed in claim 4 further comprising:

averaging the casting pool depths from the selected electrical signals from the desired locations for providing the determined casting pool depth.

6. The method of continuously casting metal strip as claimed in claim 4 comprising in addition the steps of:

determining a target casting speed and a target casting pool depth to produce a cast strip of desired thickness when casting at the target casting speed;

determining the difference between the determined casting pool depth and the target casting pool depth; and controlling the flow of molten metal from the metal supply system into the casting pool responsive to the difference between the determined casting pool depth and the target casting pool depth.

7. The method of continuously casting metal strip as claimed in claim 6 where the target pool depth is determined in accordance with the following equation:

$$h = R\sin\left[\frac{u}{R} * \frac{d^2}{k^2}\right]$$

where h=pool depth (mm), R=casting roll radius (mm), d=half strip thickness (mm), k=roll k-factor (mm/min$^{0.5}$), u=casting speed (mm/min), and $k=d/\sqrt{t}$ where, d is the half strip thickness and t is solidification time.

8. The method of continuously casting metal strip as claimed in claim 1 where the metal supply system comprises a tundish capable of delivering molten metal through a distributor to a delivery nozzle, and the step of controlling the flow of molten metal from the metal supply system into the casting pool is performed by controlling the flow of molten metal from the tundish to the distributor.

9. The method of continuously casting metal strip as claimed in claim 8 comprising in addition:

sensing the height of the molten metal in the distributor and producing electrical signals indicative of the height of the molten metal in the distributor; and controlling the flow of molten metal from the tundish to the casting pool responsive to the electrical signals indicative of the height of molten metal in the distributor.

10. The method of continuously casting metal strip as claimed in claim 9 where the step of sensing the height of the molten metal in the distributor comprises:

sensing the weight of the molten metal in the distributor and producing electrical signals indicative of the weight of the molten metal in the distributor.

11. The method of continuously casting metal strip as claimed in claim 1 further comprising:

producing electrical signals corresponding to the sensed images of the flow of molten metal into the delivery nozzle in each of the plurality of locations;

receiving the electrical signals indicative of the flow of molten metal into the delivery nozzle in each of the plurality of locations; and controlling the flow of molten metal from the metal supply system into the delivery nozzle responsive to the electrical signals indicative of the flow of molten metal into the delivery nozzle.

12. The method of continuously casting metal strip as claimed in claim 1 comprising:

maintaining at least a portion of the metal supply system responsive to the sensed images of the flow of molten metal into the delivery nozzle.

13. The method of continuously casting metal strip as claimed in claim 1 where the step of sensing images is performed by a plurality of cameras operatively positioned in the casting area.

14. The method of continuously casting metal strip as claimed in claim 13 where at least one camera is operatively positioned adjacent a side dam retaining the casting pool at an end of the casting rolls.

15. The method of continuously casting metal strip as claimed in claim 13 where at least one fiber optic sensor is operatively positioned adjacent a side dam retaining the casting pool at an end of the casting rolls and connected to at least one camera capable of generating an image indicating the flow of molten metal sensed by the fiber optic sensor.

16. The method of continuously casting metal strip as claimed in claim 13 where at least one fiber optic sensor is operatively positioned adjacent a side dam retaining the casting pool at an end of the casting rolls and connected to a control system capable of controlling the flow of molten metal into the delivery nozzle.

17. The method of continuously casting metal strip as claimed in claim 1 where the step of sensing an image includes providing a plurality of fiber optic sensors operatively positioned in the casting area.

18. The method of continuously casting metal strip as claimed in claim 1 further comprising:

sensing an image of the casting pool in at least four locations in the casting area.

19. A method of continuously casting metal strip comprising:

assembling a pair of counter-rotatable casting rolls having casting surfaces laterally positioned to form a nip therebetween through which thin cast strip can be cast, a tundish capable of delivering molten metal through a distributor to a delivery nozzle capable of delivering molten metal above the nip and forming a casting pool of molten metal supported on the casting surfaces above the nip in a casting area with side dams adjacent the ends of the nip to confine the casting pool;

sensing the height of the molten metal in the distributor and producing electrical signals indicative of the height of the molten metal in the distributor;

sensing an image of the flow of molten metal from the metal supply system into the delivery nozzle in a plurality of locations in the casting area displaying the sensed images to an operator;

controlling the flow of molten metal from the tundish to the delivery nozzle and the casting pool responsive to the electrical signals indicative of the height of molten metal in the distributor and the delivery nozzle.

20. The method of continuously casting metal strip as claimed in claim 19 where the step of sensing the height of the molten metal in the distributor comprises:

sensing the weight of the molten metal in the distributor and producing electrical signals indicative of the weight of the molten metal in the distributor.

21. The method of continuously casting metal strip as claimed in claim 19 further comprising the steps of:

sensing images of the casting pool in a plurality of locations in the casting area indicative of the casting pool depth in each of the plurality of locations;

displaying the sensed images to an operator;

controlling the flow of molten metal from the metal supply system into the casting pool responsive to the sensed images indicative of the casting pool depth.

22. The method of continuously casting metal strip as claimed in claim 21 further comprising the steps of:

producing separate electrical signals corresponding to the sensed images indicative of the casting pool depth in each of the plurality of locations;

receiving the separate electrical signals indicative of the casting pool depth in each of the plurality of locations; and controlling the flow of molten metal from the metal supply system into the casting pool responsive to one or more of the electrical signals.

23. The method of continuously casting metal strip as claimed in claim 22 further comprising:

processing the electrical signals to determine the casting pool depth in each of the plurality of locations and displaying the casting pool depth to the operator.

24. The method of continuously casting metal strip as claimed in claim 23 comprising in addition the steps of:

selecting one or a combination of the separate electrical signals indicative of desired sensed images of the casting pool depth in desired locations for providing the determined casting pool depth; and controlling the flow of molten metal from the metal supply system into the casting pool responsive to the determined casting pool depth.

25. The method of continuously casting metal strip as claimed in claim 24 further comprising:

averaging the casting pool depths from the selected electrical signals from the desired locations for providing the determined casting pool depth.

26. The method of continuously casting metal strip as claimed in claim 24 comprising in addition the steps of:

determining a target casting speed and a target casting pool depth to produce a cast strip of desired thickness when casting at the target casting speed;

determining the difference between the determined casting pool depth and the target casting pool depth; and controlling the flow of molten metal from the metal supply system into the casting pool responsive to the difference between the determined casting pool depth and the target casting pool depth.

27. The method of continuously casting metal strip as claimed in claim 26 where the target pool depth is determined in accordance with the following equation:

$$h = R\sin\left[\frac{u}{R} * \frac{d^2}{k^2}\right]$$

where h=pool depth (mm), R=casting roll radius (mm), d=half strip thickness (mm), k=roll k-factor (mm/min$^{0.5}$), u=casting speed (mm/min), and $k=d/\sqrt{t}$ where, d is the half strip thickness and t is solidification time.

28. The method of continuously casting metal strip as claimed in claim 19 where the step of controlling the flow of molten metal from the tundish to the casting pool is performed by controlling the flow of molten metal from the tundish to the distributor.

29. The method of continuously casting metal strip as claimed in claim 21 where the step of controlling the flow of molten metal from the tundish to the casting pool is performed by controlling the flow of molten metal from the tundish to the distributor.

30. The method of continuously casting metal strip as claimed in claim 19 further comprising:

producing electrical signals corresponding to the sensed images of the flow of molten metal into the delivery nozzle in each of the plurality of locations;

receiving the electrical signals indicative of the flow of molten metal into the delivery nozzle in each of the plurality of locations; and controlling the flow of molten metal from the metal supply system into the delivery nozzle responsive to the electrical signals indicative of the flow of molten metal into the delivery nozzle.

31. The method of continuously casting metal strip as claimed in claim 19 comprising:

maintaining at least a portion of the metal supply system responsive to the sensed images of the flow of molten metal into the delivery nozzle.

32. The method of continuously casting metal strip as claimed in claim 21 where the step of sensing an image is performed by a plurality of cameras operatively positioned in the casting area.

33. The method of continuously casting metal strip as claimed in claim 32 where at least one camera is operatively positioned adjacent one of the side dams.

34. The method of continuously casting metal strip as claimed in claim 32 where the step of sensing an image includes at least one fiber optic sensor operatively positioned adjacent one of the side dams.

35. The method of continuously casting metal strip as claimed in claim 21 where the step of sensing an image includes providing a plurality of fiber optic sensors operatively positioned in the casting area.

36. The method of continuously casting metal strip as claimed in claim 21 where the step of sensing an image includes sensing an image of the casting pool in at least four locations in the casting area.

* * * * *